US006199655B1

(12) United States Patent
Norris

(10) Patent No.: US 6,199,655 B1
(45) Date of Patent: Mar. 13, 2001

(54) HOLOGRAPHIC TRANSPARENT SPEAKER

(75) Inventor: Elwood G. Norris, Poway, CA (US)

(73) Assignee: American Technology Corporation, San Diego, CA (US)

( * ) Notice: Subject to any disclaimer, the term of this patent is extended or adjusted under 35 U.S.C. 154(b) by 0 days.

(21) Appl. No.: 09/426,561

(22) Filed: Oct. 22, 1999

(51) Int. Cl.[7] ..... G10K 13/00
(52) U.S. Cl. ..... 181/173; 381/431
(58) Field of Search ..... 181/157, 161, 181/171, 173, 199; 381/431

(56) References Cited

U.S. PATENT DOCUMENTS 3,136,867 6/1964 Brettell .
3,935,397 1/1976 West .
4,105,877 8/1978 Peters .
4,533,794 8/1985 Beveridge .
5,392,358 2/1995 Driver .
5,400,414 * 3/1995 Thiele ..... 381/431

* cited by examiner

*Primary Examiner*—Khanh Dang
(74) *Attorney, Agent, or Firm*—Thorpe, North & Western, LLP

(57) ABSTRACT

A speaker device has a first plate and a second plate disposed behind the first plate. A speaker membrane is disposed between the plates electrically coupled to a driver which supplies an electric signal causing the membrane to vibrate and create sound waves. The first and second plate have a first and second pattern, respectively, of regularly spaced and similarly sized openings. The openings of the first and second patterns may be similarly sized and spaced or the openings of the first pattern may be larger and spaced further apart than the openings of the second pattern. A support structure joins the first and second plates together in a fixed, spaced relationship and at a relative positional orientation, or at a relative rotational orientation. The orientation of the plates develops a repeating pattern of recurring geometric images.

25 Claims, 6 Drawing Sheets

HOLOGRAPHIC TRANSPARENT SPEAKER

BACKGROUND OF THE INVENTION

1. Field of the Invention

The present invention relates to audio speakers and more particularly to speakers which include a transparent aspect allowing a listener to see through the speaker.

2. Prior Art

Aesthetic appearance has always been a key element of audio speaker marketing. Indeed, much of the cost of conventional speakers arises from the high cost of expensive woods and trim applied to match a desired room decor. Accordingly, traditional design strategies have centered on creating visual appeal by enhancement of woods, fabrics and metals combined to provide a sense of richness.

Transparency by itself has been applied to electrostatic speakers, in view of known transparency of Mylar (R) and its acknowledged utility as an electrostatic emitter. Because grids and film are the primary components of electrostatic speakers, some aspect of transparency is known. However, the construction of these electrostatic speakers lack depth and three-dimensional character. Accordingly, the development of an aesthetically pleasing appearance with richness and depth was not a combination which was predictable.

OBJECTS AND SUMMARY OF THE INVENTION

It is an object of the present invention to provide uniqueness to a speaker by concurrently developing transparency and depth at the same time.

It is another object of the present invention to provide a speaker which provides a source of deep and full sound, yet seemingly from air and openness.

It is a further object of the present invention to provide a an unexpected audio response to a transparent speaker device.

It is a yet another object of the present invention to develop a three-dimensional appearance with a thin, flat speaker device.

These and other objects and advantages of the present invention are realized in a speaker device comprising a first perforated plate having a substantially continuous array of openings disposed across a height and width of the plate; a second perforated plate having a substantially continuous array of corresponding openings at least partially aligned with the openings of the first perforated plate; and a speaker diaphragm disposed in tension between the first and second perforated plates and operable as a vibrating element for emitting sound in accordance with an applied voltage. This diaphragm includes transparent properties allowing vision through the respective first and second plates and the speaker diaphragm.

By positioning the plate having larger openings between the observer and the plate having smaller openings, a perception of three-dimensions is provided to the thin speaker device.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1:
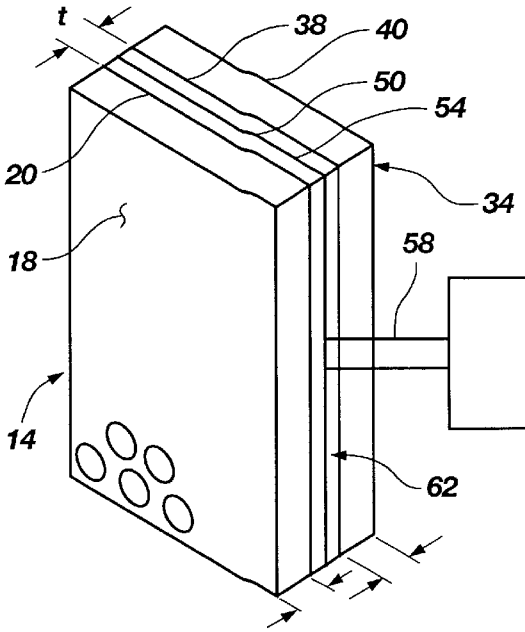
FIG. 1 is perspective view of a preferred embodiment of a speaker device of the present invention.
Figure 2:
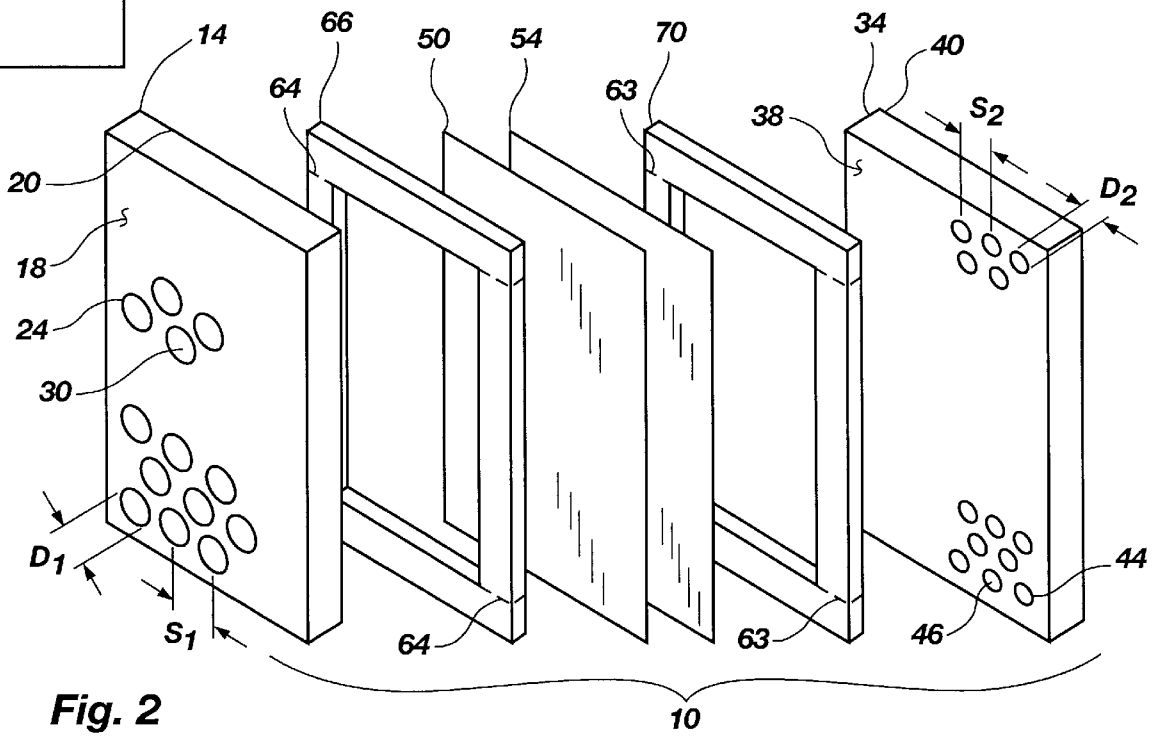
FIG. 2 is an exploded view of the preferred embodiment of the speaker device of the present invention.

As illustrated in FIGS. 1 and 2, a speaker device, indicated generally at 10, in accordance with the present invention is shown. The speaker device 10 may form part of an electrostatic speaker. The speaker device 10 has a first plate 14 with front and back surfaces 18 and 20. The first plate 14 is preferably flat or planar, but may be shaped or have a curvature. The first plate 14 also has a first pattern of first openings 24, or plurality of openings, formed in the first plate 14 and extending from the front surface 18 to the back surface 20.

The first openings 24 also have a side wall 30 formed by the first plate 14 surrounding and defining the opening 24. The first openings 24 preferably are similarly spaced and similarly sized, or have common sizes Thus, the openings 24 may have a first spacing, indicated by S1, or be spaced apart by a distance. The spacing or distance S1 may be measured from the center of one opening to the center of an adjacent opening, or from the side or edge of one opening to the side or edge of an adjacent opening. The openings also may have a first size, width, or diameter, indicated by D1 The diameter D1 is measured across opposing sides of the opening.

In addition, the openings 24 preferably are circular or cylindrical. It is of course understood that the openings 24 need not be circular, but may be any desired shape, including for example, octagonal, square, rectangular, oval, triangular, etc.

Furthermore, the openings 24 may be arranged or patterned in rows, with the openings in one row being offset with respect to the openings in an adjacent row, as shown. Alternatively, the openings may be formed in rows with the openings in one row being aligned with the openings in an adjacent row, or so that the openings are aligned in rows and columns.

The speaker 10 also has a second plate 34 disposed behind and spaced apart from the first plate 14. The second plate 34 has front and back surfaces 38 and 40. Like the first plate 14, the second plate 34 is preferably flat or planar and has a second pattern of openings 44, or plurality of openings extending from the front surface 38 to the back surface 40.

Likewise, the second openings 44 also have a side wall 46 formed by the second plate 34 surrounding and defining the openings 44. The second openings 44 preferably are similarly spaced and similarly sized, having a second spacing, indicated by S2, and a second diameter, indicated by D2. In addition, the openings 44 preferably are circular or cylindrical. Furthermore, the openings 44 may be arranged or patterned in rows.

The first and second plates 14 and 34 are preferably the same size and shape. The plates 14 and 34 may be any desired shape, including for example rectangular, square, circular, oval, etc. Each plate 14 and 34 also has a perimeter or edge. The plates may be formed of plastic.

The speaker 10 has a speaker diaphragm or membrane 50, or first membrane, disposed between the first and second plates 14 and 44. The speaker membrane 50 is transparent and may have the same size and shape of the first and second plates 14 and 34. The membrane 50 also has a perimeter or edge.

The first and second plates 14 and 34 may be electrostatic stator members which form part of a push-pull speaker system. In addition, the membrane 50 may be an electrostatic speaker diaphragm. The membrane 50 may be a polymer film with a conductive layer responsive to an applied voltage. The membrane 50 may be a material such as Mylar (R) and Kapton (R). The speaker 10 also may have a second transparent membrane 54 disposed between the first and second plates 14 and 44.

Electrical contacts 58 are electrically coupled to the first and/or second membranes 50 and 54. The electrical contacts 58 are also electrically coupled to a driver 56 which provides an electrical signal. The electrical signal is communicated by the electrical contacts 58 from the driver 56 to the membranes 50 and 54 where it becomes an applied electric field. The electrical signal or applied electric field causes the membrane to vibrate, thus producing sound waves. The driver 56 may be any desired driver and are well known to those of skill in the art.

The speaker 10 has a support structure 62 coupled to and between the first and second plates 14 and 34 to join the plates 14 and 34. The support structure 62 couples the plates 14 and 34 in a fixed, spaced relationship with respect to one another. The support structure 62 also coupled the membranes 50 and 54 to the plates 14 and 34.

The support structure 62 may extend around the perimeter of the plates 14 and 34, thus coupling the plates 14 and 34 together at the perimeters. The support structure 62 preferably extends continuously around the perimeter. Alternatively, the support structure 62 may be coupled between the plates 14 and 34 at a location within or away from the perimeter.

The support structure 62 may include a first member 66 coupled to the first plate 14, and a second member 70 coupled to the second plate 34 with the first and second members 66 and 70 being coupled to each other This support structure 62 may extend around the full perimeter, or may be disposed at opposite sides, as shown by phantom lines 63 and 64, thereby allowing free movement at the unsupported sides of the diaphragm or membrane 50 and/or 54. The speaker membrane 50 may be disposed between the first and second members 66 and 70. Thus, the membrane 50 may be suspended between the plates 14 and 34 and spaced therefrom by the support structure 62. The first and second members 66 and 70 may be adhered to the first and second plates 14 and 34, respectively, and to the speaker membrane 50. Alternatively, the first and second members 66 and 70 may be integrally formed with the first and second plates 14 and 34, respectively. The support structure 62 has a thickness, represented by t, separating the plates 14 and 34 by a space having a thickness, equally represented by t.

The support structure 62 also joins the plates 14 and 34 at a relative rotational orientation, or a relative positional orientation, to develop a repeating optical pattern of recurring geometric images, when viewed toward the front surface, which differs from both the first and second patterns of openings on the respective plates. The differing orientations of the plates 14 and 34 may form various different geometric images which may be described in various ways, as discussed more fully below. It should be noted that the speaker membranes 50 and 54 are transparent, and certain openings 24 and 44 of the plates 14 and 34 form various alignments of openings, creating virtual openings through the speaker 10, based on visual openings through (i) at least one first opening 24, (ii) the membranes 50 and/or 54, and (iii) at least one second opening 44. The virtual openings are created or modified by various orientations of the plates 14 and 34, spacing of the openings 24 and 44, and/or variable sizes of the openings 24 and 44.

Figure 3:
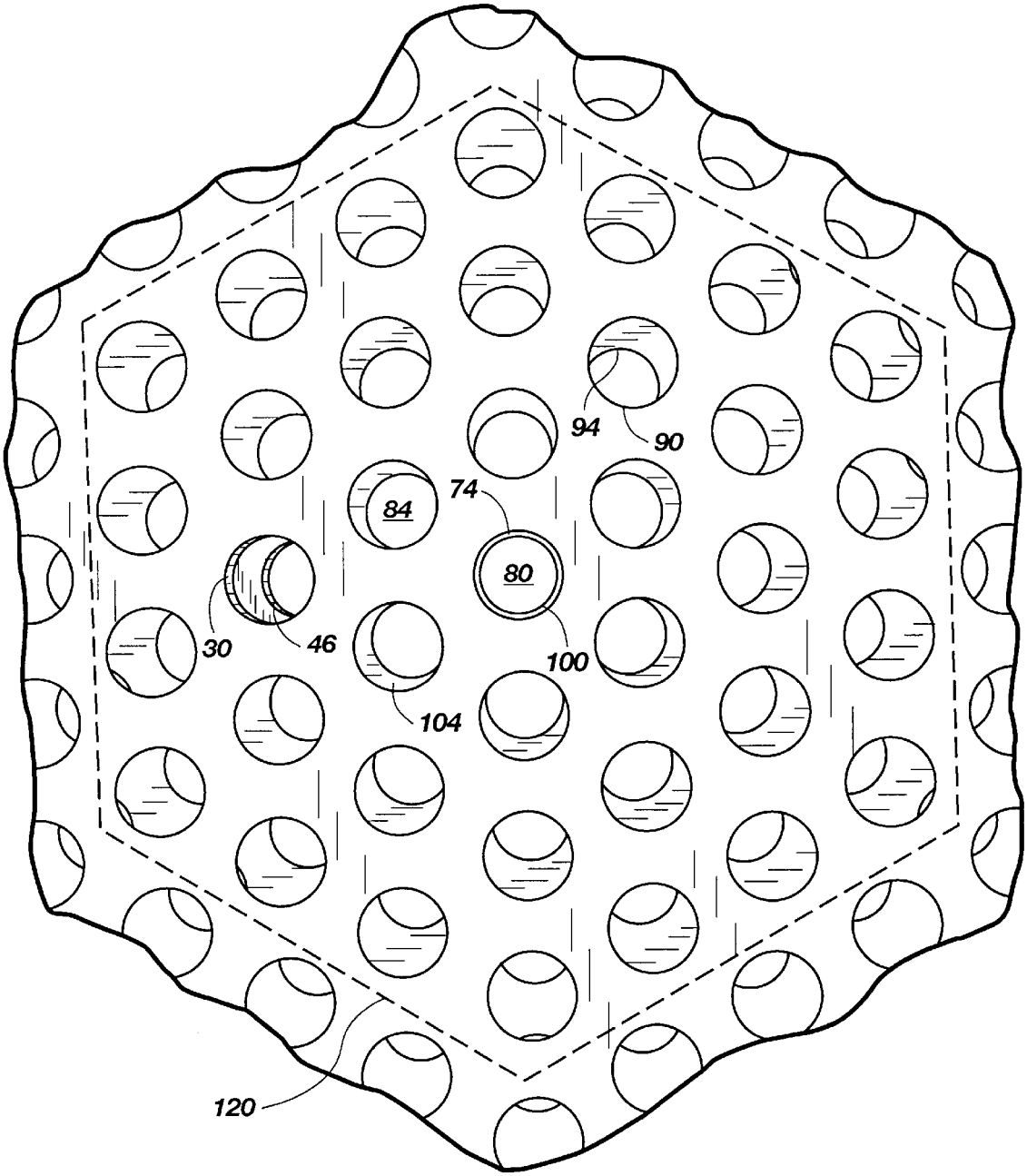
FIG. 3 is a partial front view of the preferred embodiment of the speaker device of the present invention.
Figure 4A:
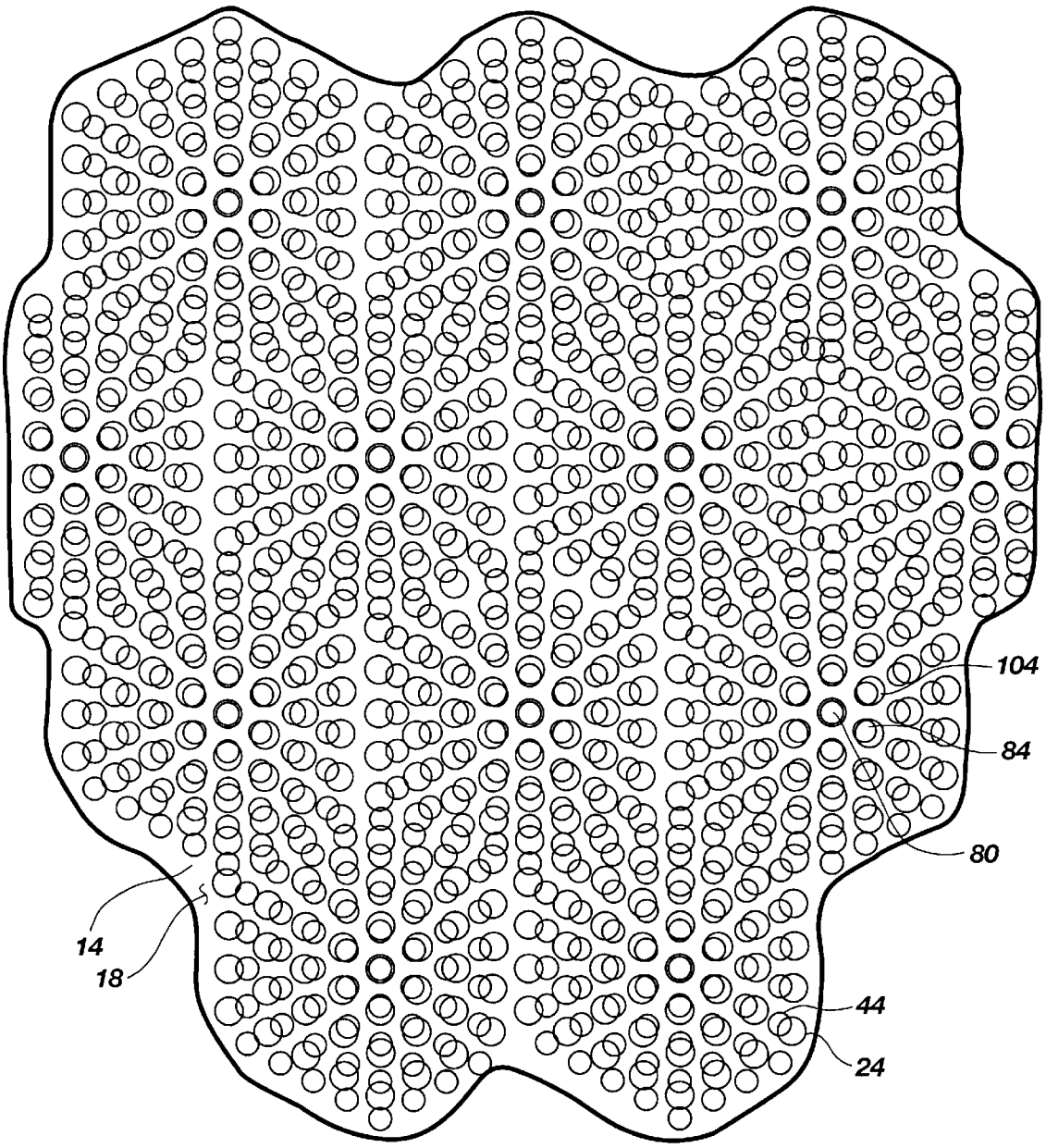
FIG. 4*a* is a partial front view of the preferred embodiment of the speaker device of the present invention.
Figure 4B:
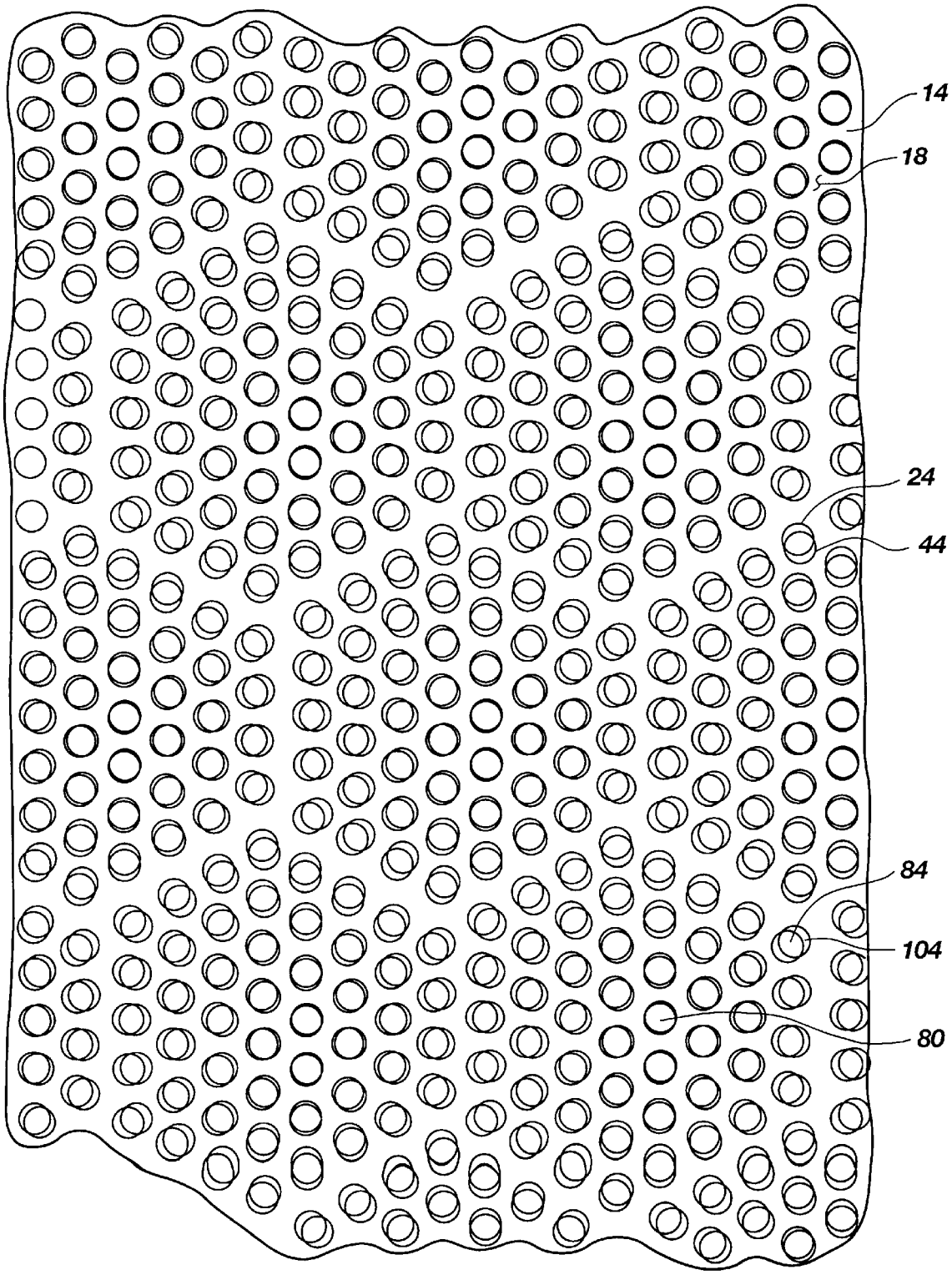
FIG. 4*b* is a partial front view of the preferred embodiment of the speaker device of the present invention.

As illustrated in FIGS. 3, 4*a* and 4*b*, an optical pattern of a geometric image is shown. It is noted that in FIGS. 4*a* and 4*b*, the openings 44 of the second plate 34 have been allowed to show through the first plate 14 in order to show the size and spacing of the openings 24 and 44 with respect to one another, and to shown the differences in the first and second patterns of openings.

The openings 24 of the first pattern or plate 14 may be spaced farther apart than the openings 44 of the second pattern or plate 34, or the first spacing S1 may be larger than the second spacing S2. Thus, the plates 14 and 34 may be positioned and oriented with respect to one another such that certain openings 24 and 44 align. Some of these openings 24 and 44 may be perfectly aligned, or aligned along a common axis, or have coaxially axes, while other openings only partially align in various ways, or partially overlap.

In addition, the openings 24 of the first pattern or plate 14 may be sized differently than the openings 44 of the second pattern or plate 34. Namely, the first openings 24 are larger than the second openings 44.

Figure 5:
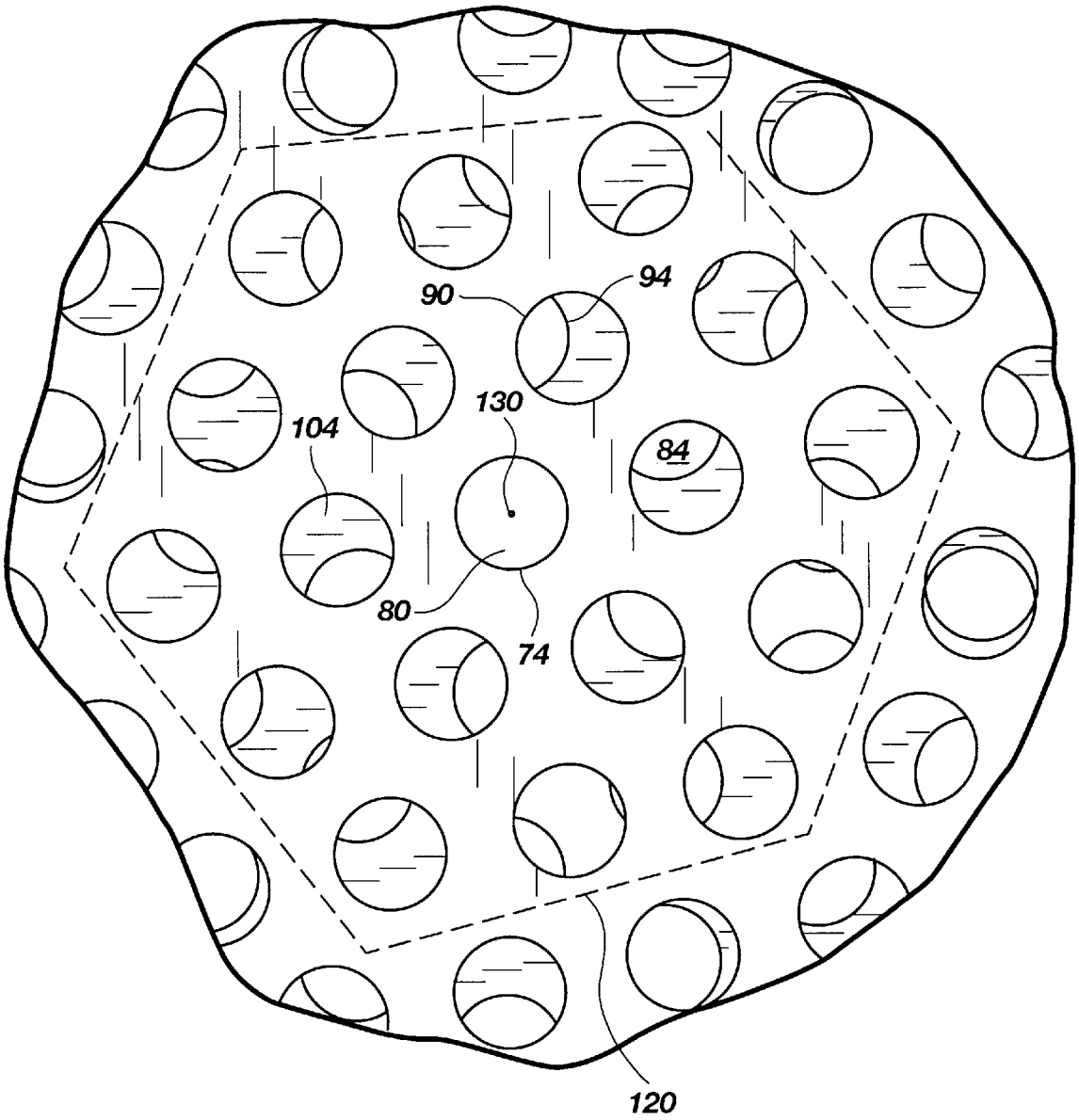
FIG. 5 is a partial front view of an alternative embodiment of a speaker device of the present invention.
Figure 6:
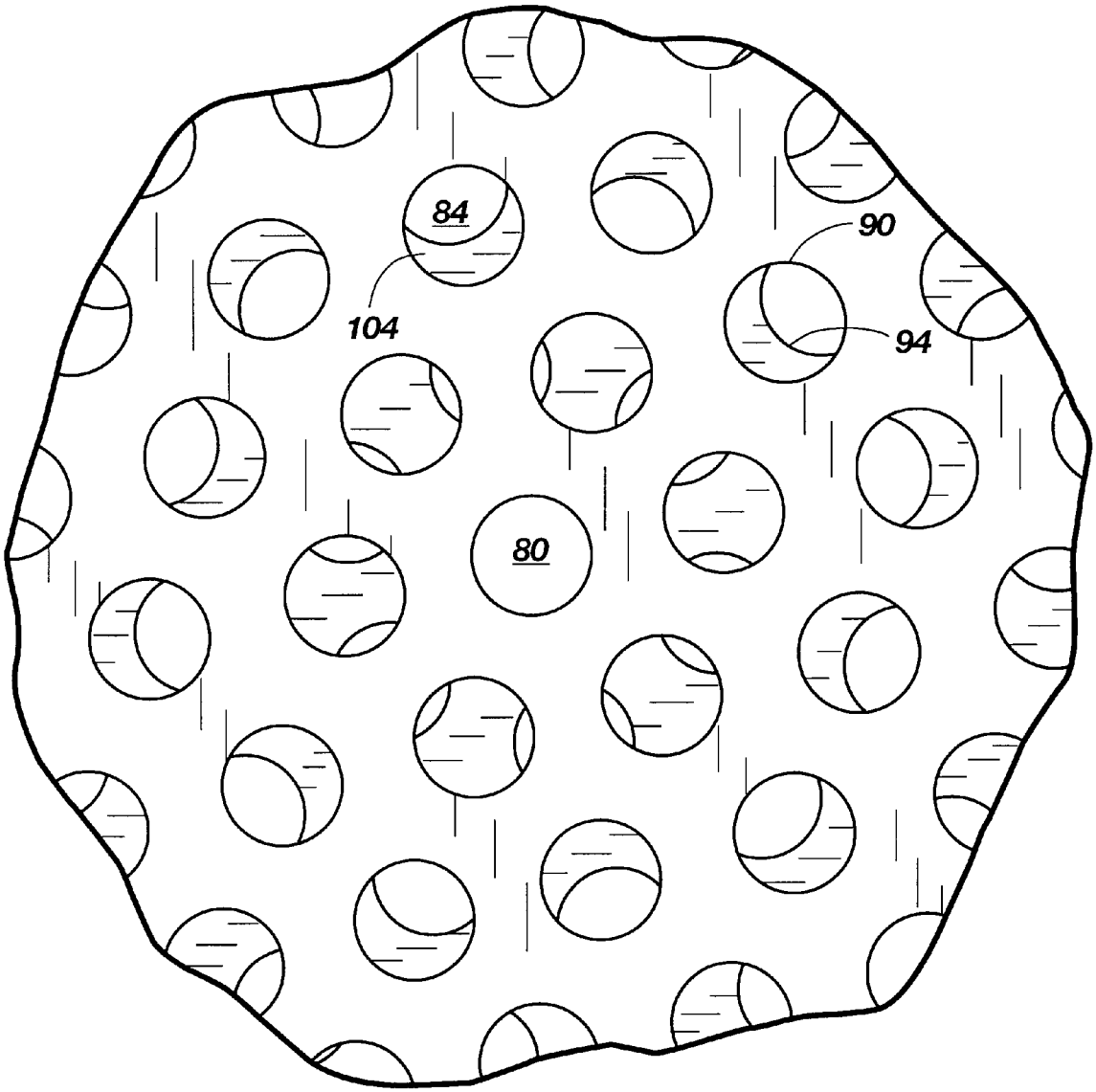
FIG. 6 is a partial front view of an alternative embodiment of a speaker device of the present invention.

Referring to FIGS. 5 and 6, the openings 24 of the first pattern or plate 14 may be spaced the same as the openings 44 of the second pattern or plate 34, or the first spacing S1 is the same as the second spacing S2. Thus, the plates 14 and 34 may be rotated and oriented with respect to one another such that certain openings 24 and 44 align. Some of these openings 24 and 44 may be perfectly aligned, or have coaxially axes, while other openings only partially align in various ways, or partially overlap. In addition, the openings 24 of the first pattern or plate 14 may be sized the same as the openings 44 of the second pattern or plate 34.

The first and second plates 14 and 34 may be oriented with respect to one another so that some of the openings 24 of the first plate 14 align with some of the openings 44 of the second plate 34 at regular intervals, indicated at 74, as shown in FIGS. 3 and 4. Alternatively, the first and second plates 14 and 34 may be rotated with respect to one another so that some of the openings 24 of the first plate 14 align with some of the openings 44 of the second plate 34 at regular intervals, also indicated at 74, as shown in FIGS. 5 and 6.

Referring to FIGS. 3–6, at least one opening 24 of the first plate 14 is aligned with one opening 44 of the second plate 34 forming a primary virtual opening 80 through the plates 14 and 34. The primary virtual opening 80 may be of circular geometry. Other openings of the first and second plates 14 and 34 overlap to create secondary virtual openings 84 through the plates 14 and 34. The secondary virtual openings 84 may be non-circular. The secondary virtual openings 84 decrease in size with location or proximity away from the primary virtual opening 80.

The first pattern of openings 24 overlaps the second pattern of openings 44 to form a pattern of virtual openings 80 and 84. Preferably the virtual openings 80 and 84 are of circular and non-circular, or partially circular, geometry. A substantial number of the virtual openings have a first circular or curved side 90 formed by the openings 24 of the first pattern or plate 14 and a second circular or curved side 94 formed by the openings 44 of the second pattern or plate 34. The first and second circular sides 90 and 94 combine to form the secondary virtual opening 84 which is non-circular, or partially circular.

Referring to FIGS. 3 and 4, the openings 24 and 44 align such that at least one opening 24 in the first plate 14 aligns with at least one opening 44 in the second plate 34 to expose a primary annular-shaped portion 100 of the second plate 34 through the at least one opening in the first plate 14. Other openings of the first and second plates 14 and 34 overlap to expose secondary crescent shaped portions 104, or partially annular segments with tapered ends, of the second plate 34 through the openings in the first plate 14.

The manner in which the first and second patterns, or the openings 24 and 44 of the first and second plates 14 and 34, align and overlap creates a recurring geometric pattern or image which differs from both the first and second patterns. In addition, the recurring geometric images are more complex and visually interesting than the simple patterns of openings in the plates. Furthermore, the images created may offer three-dimensional visual effects.

The geometric images become apparent when the speaker 10 is viewed toward the front surface 18 of the first plate 14. The images are most apparent when viewed along a line of sight perpendicular or normal to the first plate 14 or surface 18. The images are also apparent when viewed along a line of sight at an angle with respect to the first plate 14 or surface 18. When viewing the speaker 10 from the front, the front surface of the first plate is visible along with portions of the front surface 38 of the second plate 34 through the first openings 24 and the membranes 50 and 54. The front surface 38 of the second plate 34 appears somewhat darker or shadowed due to its location behind the first plate 14. Thus, the first plate 14 somewhat shadows or blocks light from reaching the front surface 38 of the second plate 34. The transparent membranes 50 and/or 54 appear somewhat reflective, or reflect a small amount of light. In addition, it is possible to see portions of the side walls 30 and 46 of the first and second openings 24 and 44. Furthermore, it is possible to see light, or other objects disposed behind the speaker 10, through the virtual openings 80 and 84. It is believed that some of these factors combine to form the unique visual effects and geometric images. These factors include the size and spacing of the openings, the orientation and/or rotation of the first and second plates or first and second patterns with respect to each other, the spacing between the first and second plates, the various portions of the side walls and second plate which are visible, the size and shape of the virtual openings, etc.

Referring to FIGS. 3 and 4, the recurring geometric images may be an intermeshing hexagonal pattern, one such hexagon indicated at 120 in FIG. 3. The images may have the appearance of three-dimensional hexagonal objects, or objects with six sides. Alternatively, the objects may have any number of sides and appear triangular, rectangular, etc.

In addition, the images may have the appearance of three-dimensional spheres or three-dimensional hexagonal objects. As indicated above, it is believed that various factors combine to create a unique three-dimensional visual effect. The images appear to have a three-dimension aspect, projecting out of or receding into the speaker or the plates. The recurring images may have the appearance of virtual concave surfaces or virtual convex surfaces.

The openings 24 and 44, or diameters D1 and D2, are preferably sized in the range of approximately 1 to 5 mm. Where larger speakers are used, greater widths may be possible.

Therefore, in addition to protecting the speaker membrane 50 and 54, the plates 14 and 34 advantageously perform an aesthetical function giving the speaker device 10 a unique visual appearance. In addition, the pattern of openings also provides a unique three-dimensional visual effect, thus giving an otherwise flat and/or thin speaker a rich, deep, or three-dimensional characteristic.

It is of course understood that the spacing and sizing of the openings, and patterning of the openings, in both plates may be altered to create the desired shape and size of the geometric image. In addition, the degree or magnitude of rotation between the plates may be varied to modify the geometric image. This is apparent from the figures, based on changing sizes and crescent shapes that would result if the two plates were rotated about a common central axis, such as at 130 in FIG. 5.

It is to be understood that the described embodiments of the invention are illustrative only, and that modifications thereof may occur to those skilled in the art. For example, the helical track may be formed on the exterior surface of a shaft or the internal surface of a cavity, while the shaft or cavity may be fixedly coupled to the head or the piston. Accordingly, this invention is not to be regarded as limited to the embodiments disclosed, but is to be limited only as defined by the appended claims herein.

What is claimed is:

1. A speaker device comprising:

a first plate having front and back surfaces and a first pattern of regularly spaced openings having common sizes and extending from the front surface to the back surface;

a second plate disposed behind and spaced from the first plate and having a second pattern of regularly spaced openings having common sizes different in size from the first pattern of openings;

a first transparent speaker membrane disposed between the first and second plates;

electrical contact means electrically coupled to the first membrane; and support structure coupled to the first and second plates to join the plates in a fixed, spaced relationship and at a relative positional orientation to develop a repeating optical pattern of recurring geometric images when viewed toward the front surface which differs from both the first and second patterns.

2. The speaker of claim 1, further comprising a second transparent speaker membrane disposed between the first and second plates.

3. The speaker of claim 1, wherein the first and second plates comprise electrostatic stator members forming part of a push-pull speaker system, the membrane comprising an electrostatic speaker diaphragm.

4. The speaker of claim 3, wherein the diaphragm comprises a polymer film which includes a conductive layer responsive to an applied voltage.

5. The speaker of claim 4, wherein the diaphragm comprises a material selected from the group consisting of Mylar (R) and Kapton (R).

6. The speaker of claim 1, wherein the openings of the first pattern are spaced farther apart than the openings of the second pattern, such that alignment of the openings in the plates varies.

7. The speaker of claim 1, wherein the first and second plates are oriented with respect to each other so that some of the openings of the first plate align with some of the openings of the second plate at regular intervals.

8. The speaker of claim 1, wherein the openings of the first plate are larger and spaced farther apart than the openings of the second plate.

9. The speaker of claim 8, wherein at least one opening of the first plate is aligned with one opening of the second plate along a common axis forming a primary virtual opening of circular geometry through the plates, and wherein other openings of the first and second plates overlap to create secondary virtual openings which are not circular.

10. The speaker of claim 9, wherein at least one hole of the first plate is aligned with one hole of the second plate creating a primary virtual opening through the plate, the holes of the first and second panels overlapping to create secondary virtual openings through the plates, the secondary virtual openings decreasing in size with location away from the primary virtual opening.

11. The speaker of claim 9, wherein the plates are oriented with respect to one another such that at least one opening in the first plate aligns with at least one opening in the second plate to expose a primary annular-shaped portion of the second plate through the at least one opening in the first plate, other openings of the first and second plates overlapping to expose secondary crescent-shaped portions of the second plate through openings in the first plate.

12. The speaker of claim 1, wherein the first pattern of openings overlaps the second pattern of openings to form a pattern of virtual openings through the plates, a substantial number of the virtual openings having a first circular side formed by the openings of the first pattern and a second circular side formed by the openings of the second pattern.

13. The speaker of claim 1, wherein the first pattern of openings overlaps the second pattern of openings to form a pattern of virtual openings of circular and non-circular geometry through the plates.

14. The speaker of claim 1, wherein the recurring geometric images are an intermeshing hexagonal pattern.

15. The speaker of claim 1, wherein the recurring geometric images have the appearance of three-dimensional hexagonal objects.

16. The speaker of claim 1, wherein the recurring geometric images have the appearance of three-dimensional spheres.

17. The speaker of claim 1, wherein the recurring geometric images have the appearance of virtual concave surfaces.

18. The speaker of claim 1, wherein the recurring geometric images have the appearance of virtual convex surfaces.

19. The speaker of claim 1, wherein the emitter forms part of an electrostatic speaker.

20. The speaker of claim 1, wherein the plates are formed of plastic.

21. The speaker of claim 1, wherein the openings are sized in the range of approximately 1 to 5 mm.

22. A speaker device comprising:

a first plate having front and back surfaces and a first pattern of regularly spaced openings having common sizes extending from the front to the back surfaces;

a second plate disposed behind and spaced from the first plate having a second pattern of regularly spaced openings having common sizes;

a first transparent speaker membrane disposed between the first and second plates;

electrical contact means electrically coupled to the first membrane; and support structure coupled to the first and second plates to join the plates in fixed, spaced relationship and at a relative rotational orientation to develop a repeating optical pattern or recurring geometric images when viewed toward the front surface which is different from both the first and second patterns.

23. The emitter of claim 22, wherein the recurring geometric images are a hexagonal pattern of virtual openings.

24. The emitter of claim 23, wherein at least one opening of the first plate is aligned with one opening of the second plate forming a primary virtual opening of circular geometry through the plates, and wherein other openings of the first and second plates overlap to create secondary virtual openings which are not circular.

25. The emitter of claim 23, wherein the first pattern of openings overlaps the second pattern of openings to form a pattern of virtual openings through the plates, a substantial number of the virtual openings having a first curved side formed by the openings of the first pattern and a second curved side formed by the openings of the second pattern.

* * * * *